US012635833B2

(12) United States Patent
McCombie

(10) Patent No.: US 12,635,833 B2
(45) Date of Patent: May 26, 2026

(54) DUAL TOWEL HOOK WITH SECURE RETENTION OF A HANGING ARTICLE

(71) Applicant: Douglas Arthur McCombie, Keller, TX (US)

(72) Inventor: Douglas Arthur McCombie, Keller, TX (US)

( * ) Notice: Subject to any disclaimer, the term of this patent is extended or adjusted under 35 U.S.C. 154(b) by 0 days.

(21) Appl. No.: 18/508,420

(22) Filed: Nov. 14, 2023

(65) Prior Publication Data

US 2024/0164596 A1 May 23, 2024

Related U.S. Application Data

(60) Provisional application No. 63/426,731, filed on Nov. 19, 2022.

(51) Int. Cl.
*A47K 10/12* (2006.01)
*A47K 10/14* (2006.01)

(52) U.S. Cl.
CPC ..... *A47K 10/12* (2013.01); *A47K 10/14* (2013.01)

(58) Field of Classification Search
CPC ..... A47K 10/12; A47K 10/14; A47K 10/00; A47K 10/02; A47K 10/04; A47K 10/10
USPC ..... 248/305, 304, 306, 307, 316.7, 303, 301
See application file for complete search history.

(56) References Cited

U.S. PATENT DOCUMENTS

| | | | | | |
|---|---|---|---|---|---|
| 451,568 | A | * | 5/1891 | Murrin | A47G 25/10 248/304 |
| 840,800 | A | | 1/1907 | Pegan | |
| 1,113,001 | A | * | 10/1914 | Goar | A22C 15/003 248/306 |
| 1,508,308 | A | * | 9/1924 | Thompson | B66C 1/36 24/599.7 |
| 1,727,200 | A | * | 9/1929 | Gillet | A47K 10/12 248/316.3 |
| 2,176,644 | A | * | 10/1939 | Sladek | A47K 10/10 248/221.11 |
| 2,299,962 | A | * | 10/1942 | Byrkit | A47K 10/12 248/305 |
| 2,557,264 | A | * | 6/1951 | Dellinger | B60R 7/10 224/927 |
| 4,039,220 | A | * | 8/1977 | Stoops | B66C 1/36 24/600.1 |

(Continued)

*Primary Examiner* — Nkeisha Smith
(74) *Attorney, Agent, or Firm* — Timothy G. Ackermann

(57) ABSTRACT

The dual towel hook with secure retention of a hanging article is a spring activated device for securing articles such as bath and hand towels, robes, garments and the like, intended for use while traveling under jolting or vibratory conditions such as recreation vehicles, smaller nautical vessels, food trucks, semi-trucks, and airplanes. The hanging article is placed onto or removed from the hook by rotating a securing clip feature that contains a torsion spring securely encapsulated in the hook assembly, in an upward direction. The tensioned securing clip retains items placed on the hook by seeking its neutral, least untensioned position and thereby either retains the article though pressure or encloses the item placed on the hook. The towel hook device also contains a secondary, non-tensioned, position to hang articles. The dual towel hook device offers a space saving alternative to other traditional and wider bath and hand towel storage devices such as towel rings and towel bars.

10 Claims, 8 Drawing Sheets

(56) References Cited

U.S. PATENT DOCUMENTS 4,826,119 A * 5/1989 Gresens ..... A47K 10/10 403/384
4,979,713 A * 12/1990 Bell ..... A47K 10/10 248/221.11
5,005,266 A * 4/1991 Fister ..... F16B 45/02 24/601.5
5,577,787 A * 11/1996 Klope ..... F16B 45/023 24/600.1
5,603,475 A * 2/1997 Lim ..... A47K 10/04 411/82
6,338,463 B1 * 1/2002 Babitz ..... F16B 45/026 248/306
6,430,759 B1 * 8/2002 Beltran ..... A47K 10/10 248/251
6,622,354 B1 * 9/2003 Klingier ..... F16B 45/023 24/599.6
6,651,830 B2 * 11/2003 Pan ..... A47K 10/10 248/251
7,926,772 B2 * 4/2011 Lowe ..... A47K 10/10 248/220.21
8,869,355 B2 * 10/2014 Huang ..... H02G 3/32 24/329
9,284,162 B2 * 3/2016 Rytkönen ..... F16B 45/036
9,332,816 B2 * 5/2016 Sakuma ..... A47G 25/0607
9,587,659 B1 * 3/2017 D'Artell ..... D06F 55/00
10,066,659 B2 * 9/2018 Osaki ..... F16B 45/026
11,122,924 B2 * 9/2021 Williams, Jr. ..... A47F 5/0876
11,274,790 B2 * 3/2022 Maclaren-Taylor .... F16B 2/065
11,578,833 B2 * 2/2023 Woolman ..... A47B 96/06
2010/0038329 A1 * 2/2010 Pan ..... A47K 1/09 248/220.21
2014/0034797 A1 2/2014 Markwardt
2016/0108953 A1 * 4/2016 Osaki ..... A47G 25/0607 248/305
2016/0369833 A1 * 12/2016 Lamarque ..... F16B 45/026

* cited by examiner

DUAL TOWEL HOOK WITH SECURE RETENTION OF A HANGING ARTICLE

CROSS-REFERENCE OF RELATED APPLICATIONS

This application claims the benefit of U.S. Provisional Application No. 63/426,731, filed Nov. 19, 2022, entitled "Bath/Towel Hook with Article Securing Feature", naming inventor Douglas Arthur McCombie, which application is incorporated by reference herein in its entirety.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A READ-ONLY OPTICAL DISC, AS A TEXT FILE OR AN XML FILE VIA THE PATENT ELECTRONIC SYSTEM

Not Applicable.

STATEMENT REGARDING PRIOR DISCLOSURES BY THE INVENTOR OR A JOINT INVENTOR

Not Applicable

BACKGROUND OF THE INVENTION

The following is a tabulation of some prior art that presently appears relevant.

| U.S. Patents | | |
|---|---|---|
| Pat. No. | Issue Date | Patentee |
| 840,800 | 1907 Jan. 8 | Arthur C. Pegan |

| U.S. patent application Publications | | |
|---|---|---|
| Publication No. | Publication Date | Applicant |
| 2016/0369833 A1 | 2016 Dec. 22 | Helder Dagot Lamarque |
| 2014/0034797 A1 | 2014 Feb. 6 | Terry Markwardt |

The invention relates to bath, garment, robe, or towel hooks and apparatuses for positively securing articles until manually removed. Many hook devices, when properly installed, can retain articles such as hand and bath towels, and personal garments in stationary, non-vibratory conditions. However, a towel hook that secures towels and articles to the hook while traveling under jolting or vibratory conditions such as recreation vehicles, smaller nautical vessels, food trucks, semi-trucks, and airplanes, for example, greatly reduces the chances of items dislodging (i.e. falling to the floor).

A common drawback of towel hooks that are used to hold fabric towels, robes, and the like, in mobile conveyances is the lack of positive retention of the item(s) and the common result of the item(s) dislodging during transit. Although "ring" type towel holders and horizontal bar type towel holders are other options for storing towels and the like, the installation and use of these devices can be limited to the configuration and/or lack of space in smaller spaces in mobile conveyances (e.g. lavatories) and stored items are also susceptible to disengagement during transit. Many rolled towel holders can provide positive attainment of towels during transit, however they are generally wide, must be unrolled for use, and generally, not re-rolled (for drying purposes) during transit.

Therefore, a need exists in the field of towel hooks and apparatus capable of positively securing towels, articles (usually made of fabric) and the like, to its intended storage/securement device, usually mounted in a vehicle or vessel living space, lavatory space wall or door location. A further need exists for a positively securing towel apparatus that is relatively narrow in width such that it can be readily installed solitarily or in multiples adjacent to each other, where space is a constraint.

The Dual Towel Hook with Secure Retention of a Hanging Article, henceforth referred to as a "dual towel hook device", can also offer article retention in static, non-vibratory environments too, especially if the hung articles are susceptible to being regularly brushed up against or removed by young children unable to re-stow items due to their smaller height. Additionally, the dual towel hook device has a secondary storage position to hang towels, articles, and the like, in a non-secured (non-retained) status.

Towel hooks or similar devices that offer retention or secure capture of towels, robes, garments and other articles do exist but are generally designed to serve unique functions or situations. For example, the objective of Locked Coat Hook, documented in U.S. Pat. No. 840,800, Jan. 8, 1907, was to securely hold coats or other garments such that no one but the owner may remove the coats or garments, as the device was locked with a lock-bolt and key apparatus. The design does offer a non-secured or non-retained article storage position. However, the adaptation of the Locked Coat Hook to positively retain articles in conveyances traveling under jolting or vibratory conditions, such as recreation vehicles, is impractical in its current form due to the excessive effort to free articles from the Shackle Bar and Hook arrangement, the limitation in the apparatus surface mounting options, and the relatively long depth that the design requires for it function (i.e. a potential obstruction hazard in space constrained areas).

The UNOCLIP, documented in United States Patent Application Publication US 2016/0369833 A1, Dec. 22, 2016, depicts a spring activated hook assembly for securely retaining articles intended for use by persons disadvantaged by loss of sight or maneuverability and require that a hung item remain on a hanger hook. The UNOCLIP publication abstract does mention applicability to mobile platforms, and does offer a position for holding articles in a non secured position, however, the suitability of the swing arm and hook body arrangement to securely retain large articles such as heavy, wet, bath towels and the like, cannot be assessed from the publication. Additionally, the depression or lateral displacement of the swing arm to release thicker articles, such as large towels, may be impractical or cannot be fully assessed from the publication details or claims.

A Towel Holder, documented in United States Patent Application Publication US 2014/0034797 A1, Feb. 6, 2014, is a towel holder states that it can be used with any towel, is easily releasable, and can be mounted onto a wall or other stationary object. The towel holder comprises of flexible "teeth" so that a portion of a towel or cloth can be pushed between the teeth which will grip and hold the towel in place, the towel is easily disengaged with a simple one hand manual pulling action. While this "push-in" type of secure retention is a desirable characteristic, the suitability of retaining large articles such as heavy, wet, bath towels, and the like, in jolting or vibratory environments, cannot be assessed from the publication or claims. Additionally, this Towel Holder does not have a secondary, non-secured, towel or article stow position, which is a desirable option in space constrained areas.

BRIEF SUMMARY OF THE INVENTION

The invention is a dual position towel hook device whereby towels, articles, and the like, are positively retained on the hook body by a partially rotated securing clip which applies an appropriate retention force, created by a spring, onto the hung item. The rotatable securing clip contains a lower bearing surface end which aligns with the hook body which exerts the "clamping" force on the hung item and an upper distal appendage to release the force (and the hung item) by rotating the securing clip upward using one's fingers or palm. The upper distal appendage of the securing clip arm is shaped such that it can also serve as a secondary, non-secured, towel or article stow position, negating the need for positive retention, in non-vibratory, non-jarring transitory environments.

Depending on the user's preference, the dual towel hook device can typically be mounted to a wall, vertical structure or door (e.g. lavatory), or other receiving surface, using ordinary hardware screw fasteners, or, on certain embodiments, using double sided, pressure sensitive adhesive tape or shaped pads.

BRIEF DESCRIPTION OF THE SEVERAL VIEWS OF THE DRAWINGS

Some embodiments of the present invention are illustrated as an example and are not limited by the figures of the accompanying drawings, in which like references may indicate similar elements, and in which.

DETAILED DESCRIPTION OF THE INVENTION

A dual towel hook device and apparatuses for positively securing fabric articles and the like, mounted to a wall, hinged door, or other receiving surface, to prevent detachment of the items while traveling under jolting or vibratory conditions are described herein. In the following description, for purposes of explanation, numerous specific details are set forth to provide a thorough understanding of the invention. Since the dual towel hook device has embodiments which operate in a hardware (fastening devices) mounted configuration and an adhesive mounted configuration, the embodiments presented for the dual towel hook device are considered equivalent from a functionality standpoint. It will be evident, however, to one skilled in the art that the present invention may be practiced without the specific details. The present disclosure is to be considered as an exemplification of the invention, and is not intended to limit the invention to the specific embodiments illustrated by the figures or description below.

Figure 1:
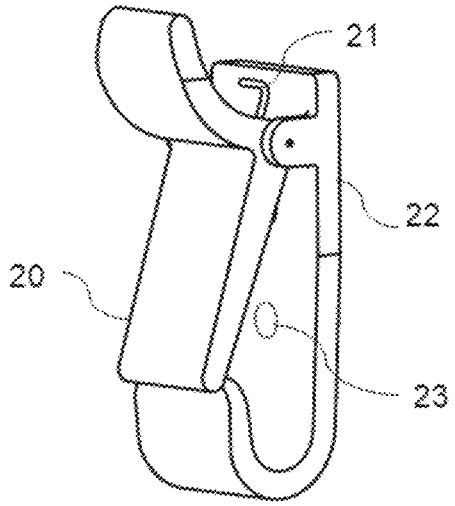
FIG. 1 is a front perspective view of a dual towel hook device of a first embodiment in which the lower storage position securely retains hanging articles using a rotating securing clip.

The dual towel hook device will be described by referencing the appended figures representing first or second embodiments. FIG. 1 depicts an isometric perspective view of the elements comprising the first embodiment of a hardware or adhesive mounted dual towel hook device with a securing feature for use in transitory conveyances such as, but not limited to, recreational vehicles, small nautical vessels, semi-tractor trucks, airplanes, and food trucks. FIG. 1 comprises of a rotatable, pivoting, securing clip 20 attached to a hook body 22 using a roll pin, a helical torsion spring 21, and mounting aperture covers 23 that are used for cosmetic purposes to cover the dual towel hook device mounting apertures or attachment screw heads. In the first embodiment, the mounting aperture cover 23 comprises of a circular disc, vinyl material, 3 to 5 mils thick, with pressure sensitive adhesive on the mating surface. In this figure, the dual towel hook device is shown in a closed position, absent of retaining a towel, robe, article, and the like.

Figure 2A:
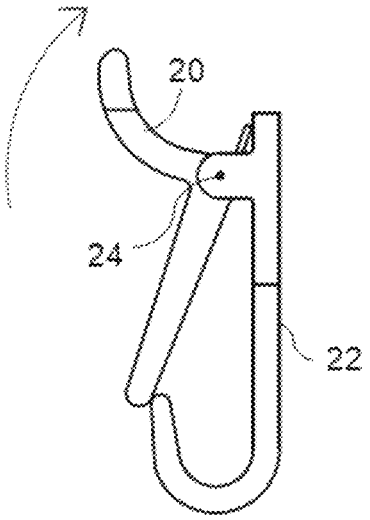
FIG. 2A is a right-side view of the dual towel hook device of the first embodiment.

FIG. 2A depicts a right-side view of the first embodiment of the dual towel hook device in the neutral position, absent of a hanging towel or article. In this view, the securing pivoting securing clip 20 can be rotated upward in the clock-wise direction by applying pressure on the upper curved distal appendage of the securing clip 20 to allow the placement of a towel or garment onto the "J" like profile positioned on the lowest portion of the hook body 22.

Figure 2B:
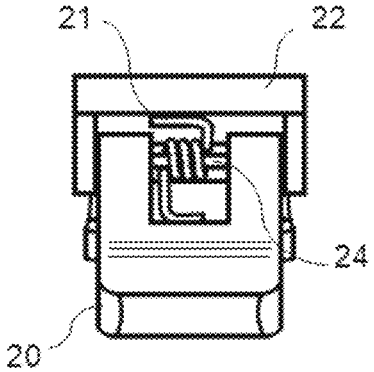
FIG. 2B is a top view of the dual towel hook device of the first embodiment.

FIG. 2B depicts a top view of the first embodiment of the dual towel hook device illustrating the entrapment of the torsion spring 21 within the securing clip 20 and the hook body 22, in which a roll pin 24 passes though a horizontal central bore within the outer pivot flanges which are positioned on the upper portion of the hook body 22, a horizontal central bore positioned in the mid-section of the securing clip 20, and the center of the torsion spring 21 coil body. In the first embodiment, the securing clip 20 contains a recessed pocket which keeps the torsion spring 21 centered.

The roll pin 24 serves as the rotation axis for the securing clip 20. In this first embodiment, the lower end of the securing clip 20 aligns with the outermost "J" profile edge of the hook body 22. Pressure is exerted on the positioned towel or article and prevents disengagement, due to the torque produced from the tightened torsion spring 21. If secure retention of towels or articles is no longer desired (i.e. hung item no longer subject to jarring, jolting, or vibratory environments), the item may be hung on the upper curved appendage of the securing clip 20, which is the non-secured position.

Figure 3:
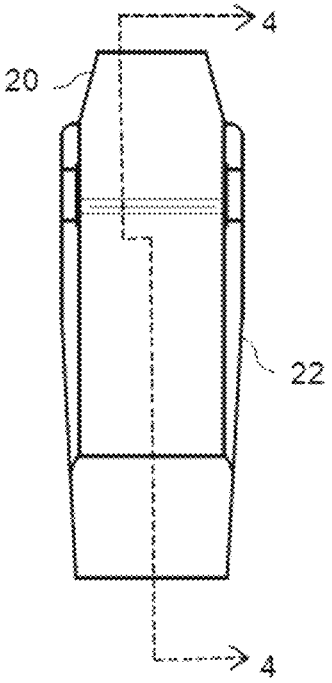
FIG. 3 is a front view of the dual towel hook device of the first embodiment with a section line to illustrate a corresponding section view.
Figure 4:
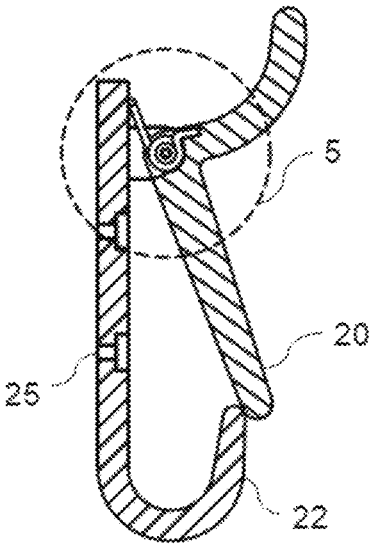
FIG. 4 is a sectional view illustrating components used for the operation of the first embodiment of a dual towel hook device.
Figure 5:
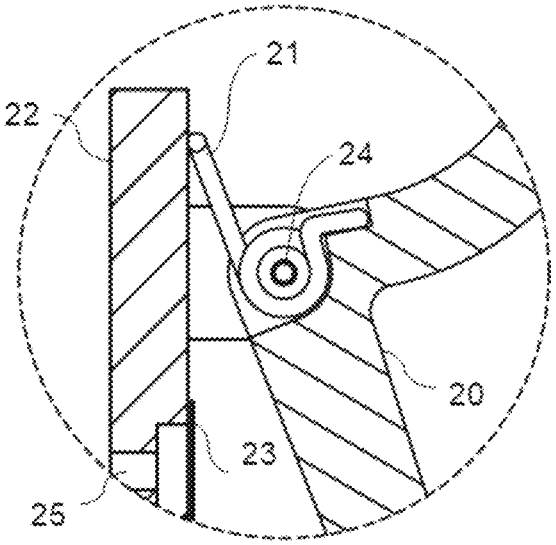
FIG. 5 is a detailed view which provides additional clarity of the components used in the dual towel hook device of the first embodiment.

Referring to FIGS. 3, 4, and 5, the torsion spring 21 is positioned within a recessed pocket in the pivoting area of the securing clip 20. The clamp like force exerted by the securing clip 20 onto the forward-most "J" profile edge of the hook body 22 results due to the arrangement of the legs of the helical torsion spring 21. One leg of the wound helical torsion spring rests along the top surface of the recessed pocket within the securing clip 20, while the opposing leg of the torsion spring contacts the upper, forward-most (front) surface of the hook body 22. The angle between the spring legs, determined by the spring winding, is configured to induce a slightly tensioned spring state in the neutral position, when the securing clip 20 contacts the forward-most surface of the hook body 22. As the securing clip 20 is rotated upward, the helical torsion spring is twisted tighter (deflected), resulting in increased torque, force, and contact pressure. The optimal contact pressure to provide positive attainment of towels or articles between the mating surfaces of the securing clip 20 and the hook body 22 is dependent on the spring rate and winding of the helical torsion spring 21.

The helical torsion spring 21 may be made from music wire, containing high-carbon spring steel, or stainless steel, and in the first embodiment, have a spring rate necessary to exert a "clamping" pressure, typically between 3 to 5 lbs./in$^2$ at the contacting end of the securing clip 20 and the "J" profile of the hook body 22. In the first embodiment, the assemblage of the securing clip 20, torsion spring 21, and hook body 22 results from inserting a roll pin 24 (i.e. spring pin) though the three components to allow rotation of the securing clip 20 while mated with the hook body 22. In the first embodiment, the hole diameters within the outer pivot flanges of the hook body 22 are slightly larger than the roll pin 24 diameter, while the hole diameter of the securing clip 20 is sized appropriately to accommodate the roll pin 24 to prevent slippage, axial movement or disengagement. Similarly, the inner coil diameter of the torsion spring 21 is comprised such that there is sufficient diametrical clearance with the roll pin 24 which may result from the torsion spring 21 rotation deflection.

The mid-section of the hook body 22 has two formed mounting apertures 25, each of which comprise of a through hole and a counterbore feature located on the hook body's inner surface. Standard hardware screws, not part of the invention and not shown, are inserted in the mounting apertures 25 to attach the flat abutment surface of the hook body 22 to the receiving surface, typically a wall, vertical surface, or hinged door (e.g. RV lavatory door) within the employed conveyance. The screw heads (not shown), which nest in the counterbored recesses and below the inner surface of the hook body 22, can be covered with two mounting aperture covers 23 for esthetic purposes.

Figure 6A:
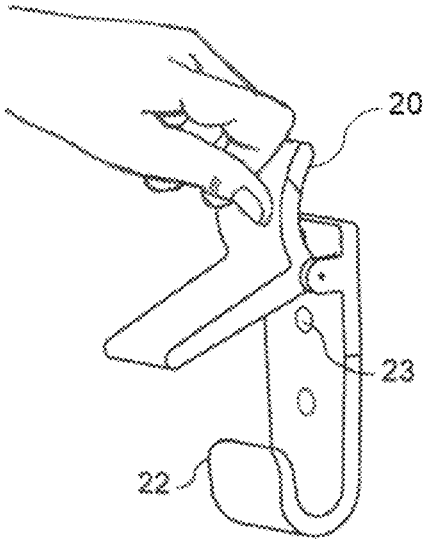
FIG. 6A is a front perspective view of the dual towel hook device of the first embodiment with the securing clip rotated to the open position.
Figure 6B:
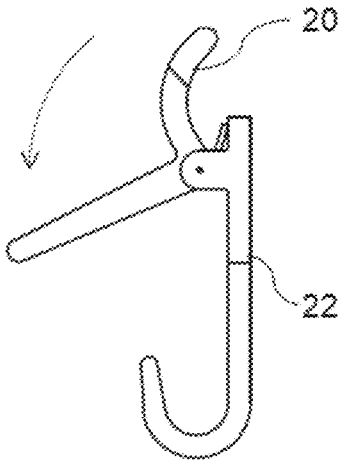
FIG. 6B is a right-side view of the dual towel hook device of the first embodiment with the securing clip rotated to the open position.
Figure 6C:
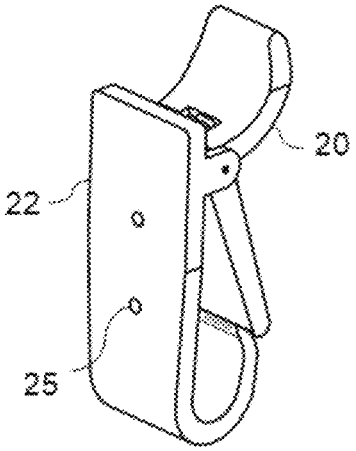
FIG. 6C is a rear perspective view of the dual towel hook device of the first embodiment illustrating mounting apertures.

Referring to FIGS. 6A, 6B, and 6C, in the first embodiment, the securing clip 20 is rotated upward (by approximately 35° to 40°) by hand to open a space such that a towel, article, and the like, can be placed on the hook body 22. The space or opening created by the upward travel of the securing clip 20 is sufficient to enable the use of standard tools (e.g. screw driver) used for the initial installation of the dual towel hook device using typical metallic screws (not shown) inserted through the mounting apertures 25.

Figure 6D:
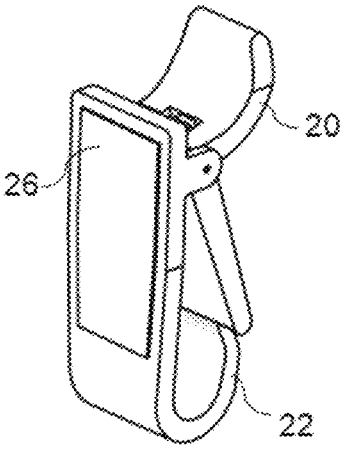
FIG. 6D is a rear perspective view of the dual towel hook device of the first embodiment depicting two-sided adhesive tape/pad used for surface mounting.

Referring to FIG. 6D, in the first embodiment, the dual towel hook device can also be initially mounted to a wall or door through the application of a "peel and stick" pressure sensitive adhesive polyethylene foam based pad 26. The adhesive tape/pad, generally 2 to 5 mils in thickness, is placed on the rear abutment surface of the hook body 22. In the adhesive mount configuration, the hardware mounting apertures visible in the back of the hook body 22 described above do not serve any purpose and are covered by the pressure sensitive tape pad 26. In general, the adhesive mounted configuration may have a lower holding capacity as the hardware mounted configuration depending on the surface condition of the wall, door, or receiving surface. When mounted on smooth walls and door surfaces, the capacity of an adhesive mounted dual towel hook device could accommodate articles (single or combined loaded) up to 13 lbs, based on a typical double sided tape shear strength of 11 lbs./in$^2$ and optimally sized adhesive pad 26 affixed to the abutment area of the hook body 22. As with the hardware mounted first embodiment, the vacant mounting apertures otherwise visible on the inner surface of the hook body 22, can be covered with two mounting aperture covers 23 for esthetic purposes.

Figure 7:
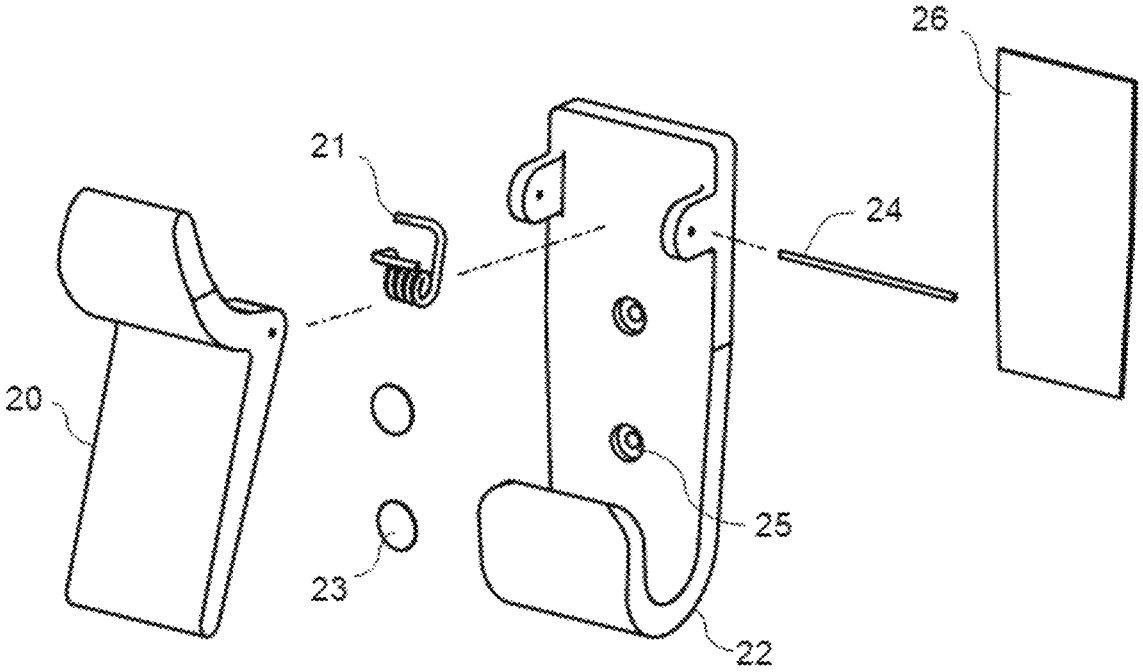
FIG. 7 is a front perspective exploded view of the dual towel hook device of the first embodiment.

FIG. 7 depicts an exploded perspective view of the elements that comprise of the first embodiment of the dual towel hook device. In this depiction, the roll pin 24 is inserted through the hook body 22 pivot flanges, securing clip 20 and torsion spring 21, to connect the components and form the device assembly.

In the first embodiment, most components of the dual towel hook device may be comprised of materials that are rust-proof/rust-resistant and support a variety of finishes or colors that are esthetically desired by the user. As such, embodiments of the securing clip 20 and hook body 22 may be made of plastic (e.g. Nylon, polyethylene, and polypropylene), urethane rubber, iron, aluminum, metallic alloys such as zinc, stainless steel, and carbon steels which depending on the material selected, may be finished with solid paint colors, brushed nickel finish, oil rubbed bronze finish, chrome finish, gold plated finish or other surface finishes.

Depending on the material used for the securing clip 20 and hook body 22 according to the first embodiment, manufacturing methods such as machining, casting, forging, extrusion, additive manufacturing, injection molding, or a combination of processes thereof, can be considered for fabrication.

Figure 8A:
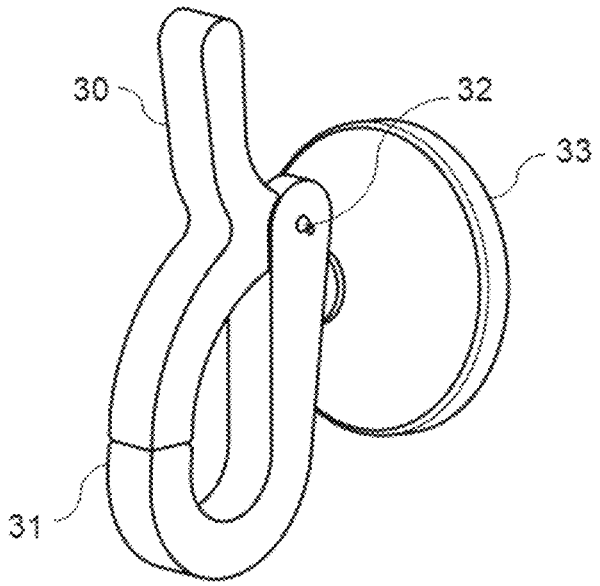
FIG. 8A is a front perspective view of the dual towel hook device of a second embodiment in which the lower storage position securely retains hanging articles using a rotating securing clip.

A second embodiment of the dual towel hook device is comprised of many of the same operational components of the first embodiment, however, the physical design appearance, securing clip rotation operation, and the method of mounting the device differs from the first embodiment. The second embodiment depicted in FIG. 8A comprises of a more contemporary look, similar in appearance to ordinary non-securing towel hooks used in a domestic home setting. FIG. 8A depicts an isometric front perspective view of the dual towel hook device comprised of a rotatable, securing clip 30 coupled to a hook body 31 using a rivet pin 32, in a neutral, closed position, absent of retaining a towel, robe, article, and the like. In this second embodiment, the rivet pin 32 operates as the axis of rotation, as well as providing a method of permanently keeping the key components together, mainly the securing clip 30, the hook body 31 and an encapsulated helical torsion spring 34 (ref FIG. 10).

Figure 8B:
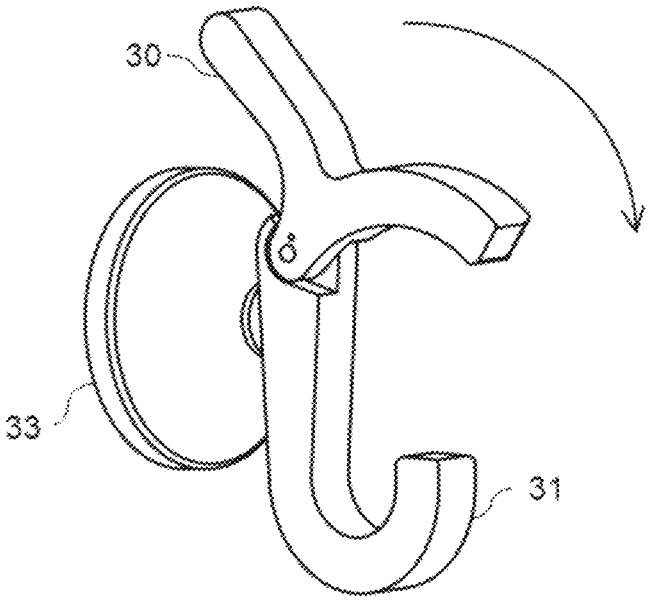
FIG. 8B is a front perspective view of the dual towel hook device of the second embodiment with the rotating securing clip rotated to the open position.

FIG. 8B depicts a front isometric perspective view of the second embodiment of the dual towel hook device in which the securing clip 30 can be rotated upward in a counter clock-wise direction (by approximately 53°) by applying pressure on the upper appendage of the securing clip 30 to allow the placement of a towel or garment onto the lowest portion of the "J" like profile of the hook body 31 prior to lowering the securing clip 30 onto the retained item. The upper appendage of the securing clip 30 acts as a lever for the rotation and a secondary peg-like structure to hang articles in a non-secured state, if desired. The range of rotation of the securing clip 30 is limited by the shape of the recessed profile of the hook body 31 which forms a lapping hinge joint between these two components.

Figure 9:
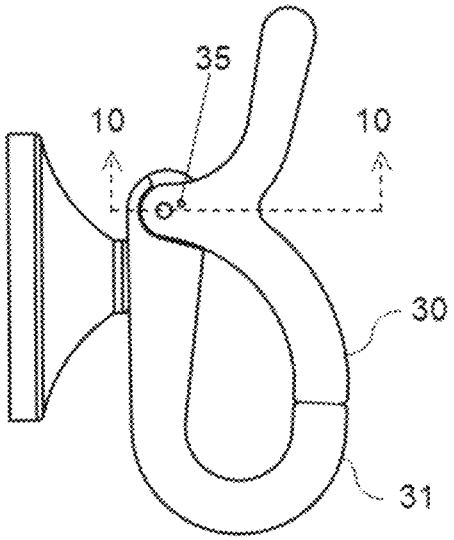
FIG. 9 is a left-side view of the dual towel hook device of the second embodiment with a section line to illustrate a corresponding section view.
Figure 10:
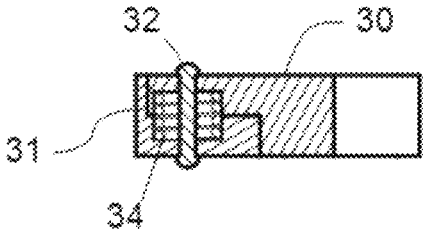
FIG. 10 is a sectional view illustrating components used for the operation of the dual towel hook device of the second embodiment.

Referring to FIGS. 9 and 10, the helical torsion spring 34 is positioned between a recessed circular pocket (i.e. counterbore) in the pivoting area of the securing clip 30 and a recessed circular pocket (i.e. counterbore) in the hook body 31. Both the securing clip 30 and hook body 31 contain a formed spring leg receiver hole 35 to retain each of the axial legs of the torsion spring 34. The retention force required to retain towels, robes, articles, and the like, results due to the upward rotation of the securing clip 30 and inherent deflection of the wound helical torsion spring 34. The optimal pressure to provide positive attainment of towels or articles between the mating surfaces of the securing clip 30 and the hook body 31 is dependent on the spring rate of the helical torsion spring 34.

The helical torsion spring 34 may be made from music wire, containing high-carbon spring steel, or stainless steel, and in the second embodiment, may have a spring rate necessary to exert a "clamping" pressure between 3 to 5 lbs./in$^2$ at the horizontal ends (working surfaces) of the securing clip 30 and hook body 31. In this second embodiment, the mid-section of the securing clip 30 and the upper portion of the hook body 31 each have a formed through hole to accommodate the rivet pin 32. The assemblage of the securing clip 30, torsion spring 34, and the hook body 31 results from inserting the rivet pin 32 though the components and forming an opposing rivet head, allowing for the appropriate tolerances to allow smooth rotation of the securing clip 30 while mated with the hook body 31.

Figure 11:
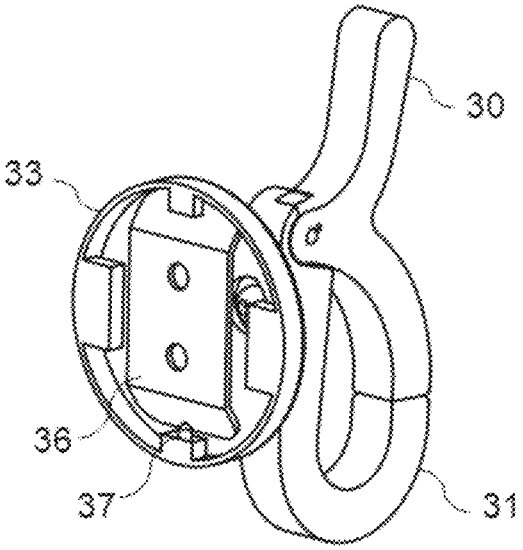
FIG. 11 is a rear perspective view of the dual towel hook device of the second embodiment illustrating components used for surface mounting using standard hardware screws (not shown).
Figure 12:
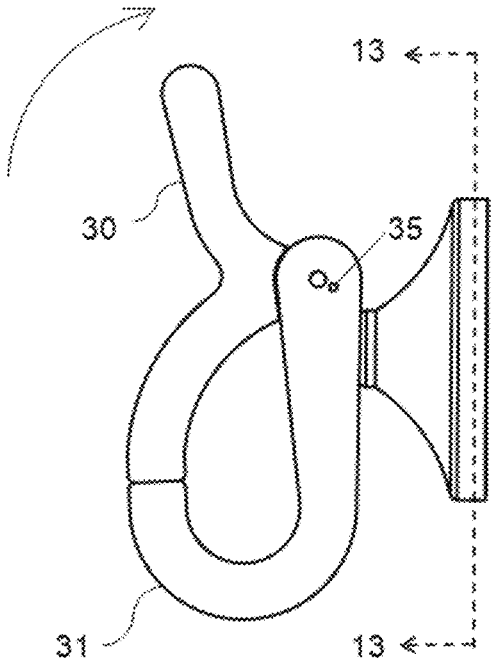
FIG. 12 is a right-side view of a dual towel hook device of the second embodiment.
Figure 13:
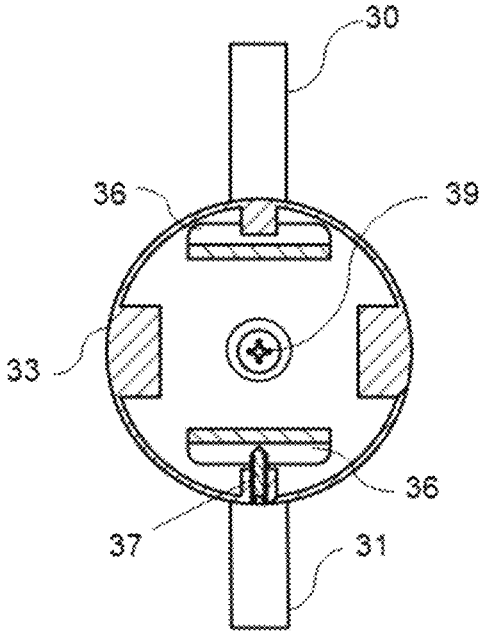
FIG. 13 is a sectional view illustrating components used for the surface mounting of the dual towel hook device of the second embodiment.

FIG. 11 depicts a rear isometric view of the second embodiment of the dual towel hook device illustrating the various components comprising the assemblage. Referring to FIGS. 11, 12, and 13, the device can be mounted to a receiving surface, typically a wall, vertical surface, or hinged door (e.g. RV lavatory door) within the employed conveyance. To mount the dual towel hook device, the abutment surface of attachment bracket 36 is affixed to a receiving surface using standard hardware screws (not shown) which are suitable for the substrate surface being mounted to. These mounting screws are not depicted in any of the figures since they are not considered an element of the device and attachment hardware can vary depending on the installation parameters. Once the flat side of the attachment bracket 36 is anchored to a receiving surface, the mount interface 33 is aligned and mated to the attachment bracket 36. In this embodiment, the upper and lower ends of the attachment bracket 36 have an angled flange which aligns to the mount interface 33. As depicted in FIG. 13, the internal hex headed cone point set screw 37 is inserted into the threaded hole 38 (ref FIG. 14) which is located on the bottom surface of the mount interface 33, and tightened until the screw tip firmly contacts the lower angled flange of the attachment bracket 36. The tightening of the set screw 37 positions the upper flange of the attachment bracket behind the upper protruding tab on the mount interface resulting in a secure installation of the device assembly to a receiving surface.

Figure 14:
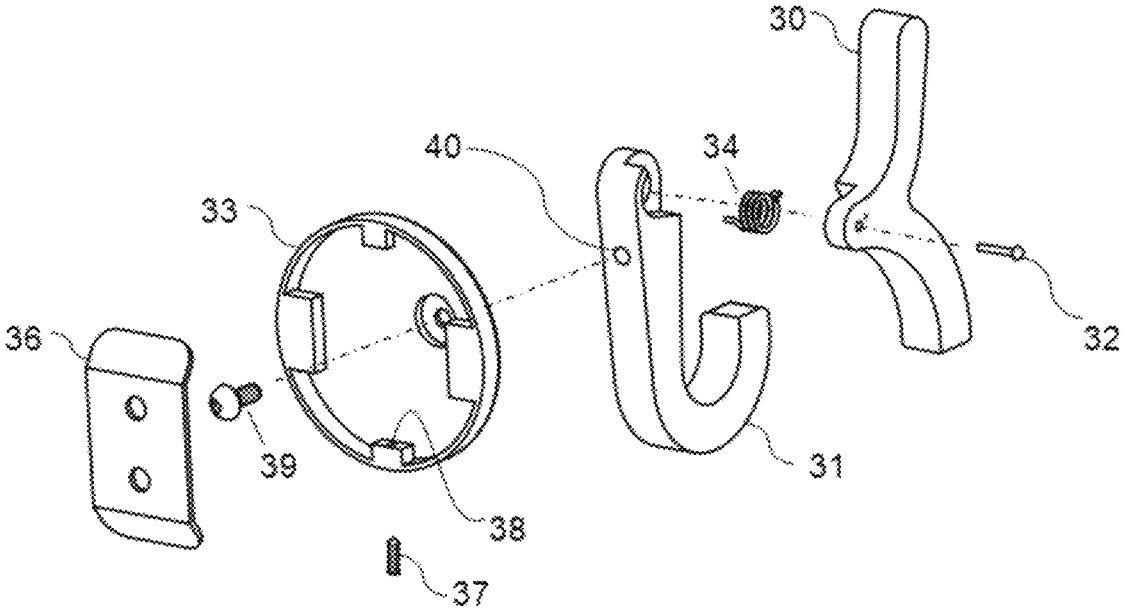
FIG. 14 is a rear perspective exploded view of a dual towel hook device of the second embodiment.

As perhaps shown best in FIG. 14, the mount interface 33 is permanently attached to the hook body 31 using a machine screw 39. In this second embodiment, the hook body 31, contains a formed threaded hole 40, to facilitate the assemblage of the mount interface 33 to the hook body 31 by inserting the machine screw 39 and tightening it to the appropriate torque that would prevent loosening or separation of the components. In some embodiments, both the hook body 31 and the mount interface 33 can be one integrated, appropriately contoured component, rather than two components as depicted in the embodiment shown.

Most components of the second embodiment of the dual towel hook device may be comprised of materials that are rust-proof/rust-resistant and support a variety of finishes or colors that are esthetically desired by the user. As such, embodiments of the securing clip 30, hook body 31, mount interface 33, and attachment bracket 36 may be made of plastic (e.g. Nylon, polyethylene, and polypropylene), urethane rubber, iron, aluminum, metallic alloys such as zinc, stainless steel, and carbon steels which depending on the material selected, may be finished with solid paint colors, brushed nickel finish, oil rubbed bronze finish, chrome finish, gold plated finish or other surface finishes.

Depending on the material used for the securing clip 30, hook body 31, mount interface 33, and attachment bracket 36, according to the second embodiment, manufacturing methods such as machining, casting, forging, extrusion, additive manufacturing, injection molding, or a combination of processes thereof, can be considered for fabrication.

The dual towel hook device is not limited to the above described embodiments but various modifications thereof may be made. Further, all such equivalent embodiments and examples are within the spirit and scope of the invention, are contemplated thereby, and are intended to be covered by the following claims.

What is claimed is:

1. A dual towel hook device with secure retention of one or more hanging articles, comprising:

a hook body;

the hook body having a rear face, a front face, and a J-shaped hook extending frontwards for hanging articles;

a securing clip;

the securing clip having a lower end including a lower surface, an upper appendage for hanging articles, and a transverse rotation axis;

a torsion spring;

the torsion spring coupling the hook body and the securing clip for rotation of the securing clip about the transverse rotation axis between an open position and a closed position;

the lower surface aligned to the front face in the closed position; and the lower end and the upper appendage on opposing sides of the transverse rotation axis; and an abutment surface connected to the hook body for mounting the dual towel hook device; and a mounted configuration on the abutment surface selected from the group consisting of:

double-sided pressure sensitive adhesive tape;

an adhesive pad; and one or more bored mounting apertures;

the mounted configuration on the abutment surface comprising one or more bored mounting apertures; and further comprising one or more aperture covers suitable for making the one or more bored mounting apertures less visible.

2. The dual towel hook device of claim 1, the upper appendage forming a lever to rotate the securing clip about the transverse rotation axis.

3. The dual towel hook device of claim 1, the securing clip in the open position causing the torsion spring to be more tensioned than the securing clip in the closed position.

4. A dual towel hook device with secure retention of one or more hanging articles, comprising:

a hook body;

the hook body having a rear face, a front face, and a J-shaped hook extending frontwards for hanging articles;

a securing clip;

the securing clip having a lower end including a lower surface, an upper appendage for hanging articles, and a transverse rotation axis;

a torsion spring;

the torsion spring coupling the hook body and the securing clip for rotation of the securing clip about the transverse rotation axis between an open position and a closed position;

the lower surface aligned to the front face in the closed position; and the lower end and the upper appendage on opposing sides of the transverse rotation axis; and an abutment surface connected to the hook body for mounting the dual towel hook device; and a mounted configuration on the abutment surface selected from the group consisting of:

double-sided pressure sensitive adhesive tape;

an adhesive pad; and one or more bored mounting apertures;

a surface mountable attachment bracket;

the surface mountable bracket comprising the abutment surface; and the surface mountable bracket connected to the hook body.

5. The dual towel hook device of claim 1, further comprising:

the surface mountable attachment bracket being attachable to and removable from the hook body using a mounting interface comprising a mechanical fastener.

6. The dual towel hook device of claim 4, the upper appendage forming a lever to rotate the securing clip about the transverse rotation axis.

7. The dual towel hook device of claim 4, the securing clip in the open position causing the torsion spring to be more tensioned than the securing clip in the closed position.

8. A dual towel hook device with secure retention of a hanging article, comprising:

a hook body;

a torsion spring;

a pin;

a securing clip coupled with the hook body;

the hook body comprising a generally uniform cross section having a J-shaped hook formed on a lowest extremity thereof, and an upper portion of the hook body having a central bore through its horizontal axis, the securing clip comprising of a lower surface aligned and coincident with a forward-most surface of the hook body J-shaped hook as coupled, a central bore through a horizontal axis coincident to the hook body central bore when coupled, an upper distal appendage, whereby articles can hang in a non-secure state, the torsion spring disposed between the hook body and securing clip, wherein a pin passes through the hook body central bore and the securing clip central bore, and the torsion spring to fasten the securing clip and hook body together, whereby the securing clip closes-off access to the hook body J-shaped hook in an alignment position in which the torsion spring is least tensioned but is easily rotated using one's finger or palm from the alignment position to hang articles which are grasped between the lower surface of the securing clip and the hook body J-shaped hook; and in which an abutment surface of the hook body is fixably attachable to a receiving mounting surface with double-sided pressure sensitive adhesive tape or an equivalent shaped adhesive pad.

9. A dual towel hook device with secure retention of a hanging article, comprising:

a hook body;

a torsion spring;

a pin;

a securing clip coupled with the hook body;

the hook body comprising a generally uniform cross section having a J-shaped hook formed on a lowest extremity thereof, and an upper portion of the hook body having a central bore through its horizontal axis, the securing clip comprising of a lower surface aligned and coincident with a forward-most surface of the hook body J-shaped hook as coupled, a central bore through a horizontal axis coincident to the hook body central bore when coupled, an upper distal appendage, whereby articles can hang in a non-secure state, the torsion spring disposed between the hook body and securing clip, wherein a pin passes through the hook body central bore and the securing clip central bore, and the torsion spring to fasten the securing clip and hook body together, whereby the securing clip closes-off access to the hook body J-shaped hook in an alignment position in which the torsion spring is least tensioned but is easily rotated using one's finger or palm from the alignment position to hang articles which are grasped between the lower surface of the securing clip and the hook body J-shaped hook; and in which an abutment surface of the hook body is fixably attachable to a receiving mounting surface, wherein the hook body includes a mid section above the lowest extremity, the mid section having a plurality of bored mounting apertures for surface penetrating fastening devices, and in which the plurality of bored mounting apertures are generally made less visible with aperture covers.

10. A dual towel hook device with secure retention of a hanging article, comprising:

a hook body;

a torsion spring;

a pin;

a securing clip coupled with the hook body;

the hook body comprising a generally uniform cross section having a J-shaped hook formed on a lowest extremity thereof, and an upper portion of the hook body having a central bore through its horizontal axis, the securing clip comprising of a lower surface aligned and coincident with a forward-most surface of the hook body J-shaped hook as coupled, a central bore through a horizontal axis coincident to the hook body central bore when coupled, an upper distal appendage, whereby articles can hang in a non-secure state, the torsion spring disposed between the hook body and securing clip, wherein a pin passes through the hook body central bore and the securing clip central bore, and the torsion spring to fasten the securing clip and hook body together, whereby the securing clip closes-off access to the hook body J-shaped hook in an alignment position in which the torsion spring is least tensioned but is easily rotated using one's finger or palm from the alignment position to hang articles which are grasped between the lower surface of the securing clip and the hook body J-shaped hook; and in which the hook body is fixably attachable to a surface mountable attachment bracket, wherein the surface mountable attachment bracket having a plurality of bored mounting apertures for surface penetrating fastening devices or having an abutment surface fixably attachable to a receiving mounting surface with double-sided pressure sensitive adhesive tape or an equivalent shaped pad, whereby the hook body is attachable to and removable from the surface mountable attachment bracket using a mounting interface consisting of mechanical fastener(s) to positively attach the hook body to the surface mountable attachment bracket.

* * * * *